US007405371B2

(12) United States Patent
Albert et al.

(10) Patent No.: US 7,405,371 B2
(45) Date of Patent: Jul. 29, 2008

(54) LOCKING APPARATUS

(75) Inventors: Clemens Albert, Goldbach (DE); Markus Hornbach, Hammersback (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 11/699,521

(22) Filed: Jan. 29, 2007

(65) Prior Publication Data

US 2007/0175739 A1 Aug. 2, 2007

Related U.S. Application Data

(60) Provisional application No. 60/763,006, filed on Jan. 27, 2006.

(51) Int. Cl.
*H01H 1/52* (2006.01)

(52) U.S. Cl. ..... 200/322; 200/43.01; 200/43.11; 200/50.11

(58) Field of Classification Search ..... 200/321–323, 200/43.01, 43.11, 43.16, 50.01–50.03, 50.11, 200/50.18, 50.19
See application file for complete search history.

(56) References Cited

U.S. PATENT DOCUMENTS

| | | | | |
|---|---|---|---|---|
| 4,219,714 | A * | 8/1980 | Suzuki et al. | 200/43.17 |
| 5,823,321 | A * | 10/1998 | Leclerc | 200/43.19 |
| 5,835,002 | A | 11/1998 | Barnett | |
| 6,207,909 | B1 * | 3/2001 | Tallman et al. | 200/50.02 |
| 6,610,946 | B2 * | 8/2003 | Covell et al. | 200/321 |
| 6,958,455 | B1 * | 10/2005 | Lui | 200/43.17 |

* cited by examiner

*Primary Examiner*—K. Richard Lee
(74) *Attorney, Agent, or Firm*—Laurence A. Greenberg; Werner H. Stemer; Ralph E. Locher

(57) ABSTRACT

A locking apparatus for a manual actuation device of a switchboard plant has a trigger mechanism that is activated by an absence of a backup or a defective backup, and a locking mechanism for the manual actuation device. The locking mechanism is coupled to the trigger mechanism and is transferable by the trigger mechanism from a first position releasing the manual actuation device into a second position locking the manual actuation device. The locking apparatus has a simple and cost-effective construction, it is proposed that the locking mechanism has a cover plate which is displaceable between two positions by the trigger mechanism and which, in its first position, blocks a lever configuration under tensile force, of the locking mechanism and, in its second position, releases the lever configuration in order to lock the manual actuation device.

8 Claims, 4 Drawing Sheets

LOCKING APPARATUS

CROSS-REFERENCE TO RELATED APPLICATIONS

This application claims the priority, under 35 U.S.C. §119 (e), of provisional application No. 60/763,006, filed Jan. 27, 2006; the prior application is herewith incorporated by reference in its entirety.

BACKGROUND OF THE INVENTION

The invention relates to a locking apparatus for a manual actuation device for electrical switching equipment. The locking apparatus has a release mechanism that is activated as a result of an absence of a backup or a defective backup, and a locking mechanism for the manual actuation device. The locking mechanism is coupled to a release mechanism and is transferable by the release mechanism from a first position releasing the manual actuation device into a second position locking the manual actuation device.

Such an apparatus is known, for example, from U.S. Pat. No. 5,835,002. The locking apparatus disclosed there is provided for locking a hand-operated actuating lever as a manual actuation device for electrical switching equipment, and in this case the manual actuation device is to be locked after a backup of the electrical switching equipment has been triggered and is consequently defective or when a backup of the electrical switching equipment is absent. In these situations, the electrical switching equipment is to be prevented from being switched on by the manual actuation device. For this purpose, the locking apparatus contains a release mechanism, which is activated as a result of an absent or defective backup, and a locking mechanism, which is coupled to the release mechanism and is in a position releasing the manual actuation device as long as there is no absent or defective backup, and, in the case of the defective or absent backup, is transferred by the triggered trigger mechanism into a position locking the manual actuation device.

SUMMARY OF THE INVENTION

It is accordingly an object of the invention to provide a locking apparatus that overcomes the above-mentioned disadvantages of the prior art devices of this general type, which has a simple and cost-effective construction.

With the foregoing and other objects in view there is provided, in accordance with the invention, a locking apparatus for a manual actuation device for electrical switching equipment. The locking apparatus contains a trigger mechanism activated by an absence of a backup or a defective backup, and a locking mechanism for the manual actuation device having a lever configuration. The locking mechanism is coupled to the trigger mechanism and is transferable by the trigger mechanism from a first position releasing the manual actuation device into a second position locking the manual actuation device. The locking mechanism has a cover plate displaceable between the first and second positions by the trigger mechanism and, in the first position, the cover plate blocks the lever configuration, under tensile force, of the locking mechanism and, in the second position, the locking mechanism releases the lever configuration to lock the manual actuation device.

The object is achieved, according to the invention, in that the locking mechanism contains a cover plate which is displaceable between two positions by the trigger mechanism and which, in its first position, blocks a lever configuration, under tensile force, of the locking mechanism and, in its second position, releases the lever configuration for locking the manual actuation device.

Such a cover plate constitutes a simple measure for blocking and releasing the lever configuration of the locking mechanism and advantageously leads to a simple and therefore cost-effective configuration.

In an advantageous refinement, the lever configuration contains a trigger lever which is mounted rotatably on a bearing arm and the first end of which is coupled to a housing of the electrical switching equipment via a tension spring and the second end of which is connected in an articulated manner to a rotatably mounted locking lever. A configuration of this type affords a simple possibility of configuring a lever configuration triggerable by the cover plate.

In a further refinement of the invention, a stop element for engagement into a clearance of the cover plate in its second position is provided on the trigger lever. By such a stop element, the cover plate of the lever configuration is blocked in a simple way, and, with the trigger mechanism triggered and with the cover plate in its second position, the lever configuration is released as a result of the engagement of the stop element into the clearance, with the result that the manual actuation device is locked in a simple way.

In a further refinement of the invention, the locking lever has a free end with a sliding face pointing in the direction of the switched-on position of the manual actuation device and an extension pointing in the direction of the switched-off position of the manual actuation device. By such a configuration of the free end of the locking lever, it is possible in a simple way for the electrical switching equipment to be switched off by the manual actuation device, even in the locked position, because the manual actuation device can slide along the sliding face and can deflect the rotatably mounted locking lever out of the locking position, and, on the other hand, with the electrical switching equipment switched off and with the locking mechanism triggered, the extension reliably prevents the electrical switching equipment from being switched on by the manual actuation device.

In an expedient development, the locking mechanism contains a manual return mechanism coupled to the trigger lever and has a hand-operated actuating lever. By a manual return mechanism of this type, it is advantageously possible, after the replacement of defective backups, to transfer the locking mechanism by hand into its position releasing the manual actuation device of the electrical switching equipment.

In an advantageous refinement of the invention, the cover plate is coupled to the trigger mechanism via a sliding linkage and joints. Advantageously, in a configuration of this type with a sliding linkage, the dead weight of the sliding linkage or an additional spring mechanism is utilized in order to hold the trigger mechanism in its non-triggering position, with a functioning backup being engaged.

In a further refinement, the trigger mechanism contains a rocker lever which is connected in an articulated manner to the sliding linkage and which is disposed rotatably in a backup housing end part and extends into the backup housing end part and beyond a backup. Backups for electrical switching equipment of this type have, in a known way, a trigger pin which, in the case of a functioning backup, is located in the backup and, in the case of a defective backup, projects out of the latter. The configuration with a rocker lever is suitable in a simple way for bringing about a rotation of the rocker lever about its rotary bearing by the trigger pin, acting directly on the rocker lever, of a defective backup, and, via the articulated connection, for pushing the cover plate of the locking mechanism into its position releasing the lever configuration.

In a further development of the invention, the trigger mechanism contains a folding plate that can be moved between a folded-in position and a folded-out position by a clip mechanism of the backup and tension spring elements of the trigger mechanism. A folding plate of this type affords a simple possibility, in the absence of a backup, for holding the rocker lever in the triggered position, until the folding plate is folded back into its second position by a backup via the clip mechanism and the rocker lever is transferred into its non-triggered position due to the dead weight of the sliding linkage.

Other features which are considered as characteristic for the invention are set forth in the appended claims.

Although the invention is illustrated and described herein as embodied in a locking apparatus, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
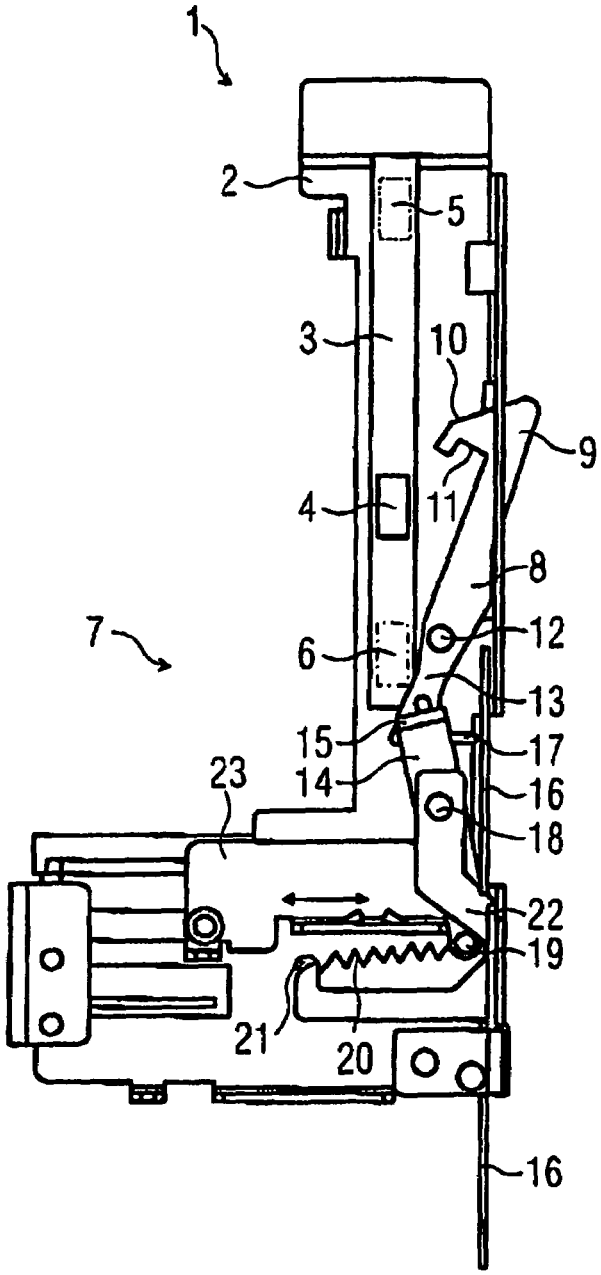
FIG. 1 is a diagrammatic, rear view of a locking apparatus according to the invention in a non-locking position.

Referring now to the figures of the drawing in detail and first, particularly, to FIG. 1 thereof, there is shown a cross-sectional view of an electrical switching apparatus or equipment 1 with a housing part 2, in which is provided an opening slot 3, into which a switch lever 4 can be inserted in order to switch the electrical switching equipment 1 on and off. The switch lever 4 serves for closing and opening non-illustrated contact systems of the respective phases of the electrical switching equipment 1, moving contacts of the contact systems being connected to and separated from fixed contacts of the contact systems by the switch lever 4 and a non-illustrated switch shaft. In the illustration represented by unbroken lines, the switch lever 4 is in a position between a current-carrying position 5, illustrated by dashes, of the electrical switching equipment 1 with closed contact systems and the switched-off position 6, illustrated by dashes and dots, of the electrical switching equipment 1 with separated contact systems. To lock the switch lever 4 in order to prevent a movement of the switch lever 4 into the current-carrying position 5 when a backup is defective or absent (e.g. fuse, breaker, etc.), a locking mechanism 7 is provided. The locking mechanism 7 contains a locking lever 8, a free end 9 of which has a sliding face 10 on a side facing the current-carrying position 5 and an extension 11 on a side facing the switched-off position 6. The locking lever 8 is mounted rotatably on a first bearing 12 and, at its end 13 located opposite the free end 9, is connected in an articulated manner to a trigger lever 14 by an articulated connection 15. The trigger lever 14 has a stop element 17 pointing in a direction of a displaceable cover plate 16 and is likewise mounted rotatably on a second bearing 18. At an end 19 located opposite the articulated connection 15, the trigger lever 14 is connected to a tension spring 20 that is fastened to the housing part 2 of the electrical switching equipment 1 at a fastening element 21. The second bearing 18 of the trigger lever 14 is disposed on a bearing arm 22 of the housing part 2. A movable return mechanism 23, when it moves in the direction of the trigger lever 14, acts against the end 19 of the trigger lever 14.

Figure 2:
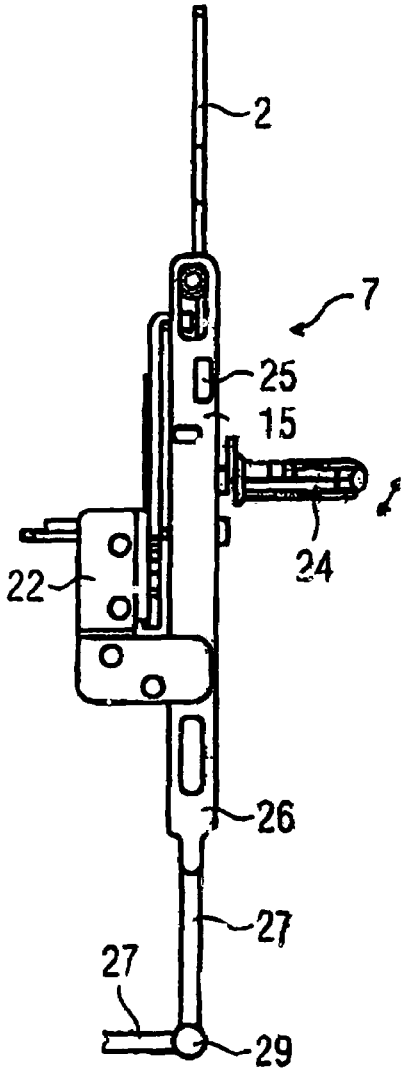
FIG. 2 is a diagrammatic, side view of the locking apparatus shown in FIG. 1.

FIG. 2 illustrates a front view of the locking mechanism 7. A hand-operated actuating mechanism 24 is provided for actuating the manual return mechanism 23 for the locking mechanism 7. A movable cover plate 16 has a clearance 25 that is provided for the engagement of the stop element 17 of the locking lever 8 in a triggering position. At its lower end 26, the cover plate 16 is connected mechanically to a sliding linkage 27. The sliding linkage 27 is coupled to a trigger mechanism 28, not illustrated in FIG. 2.

Figure 3:
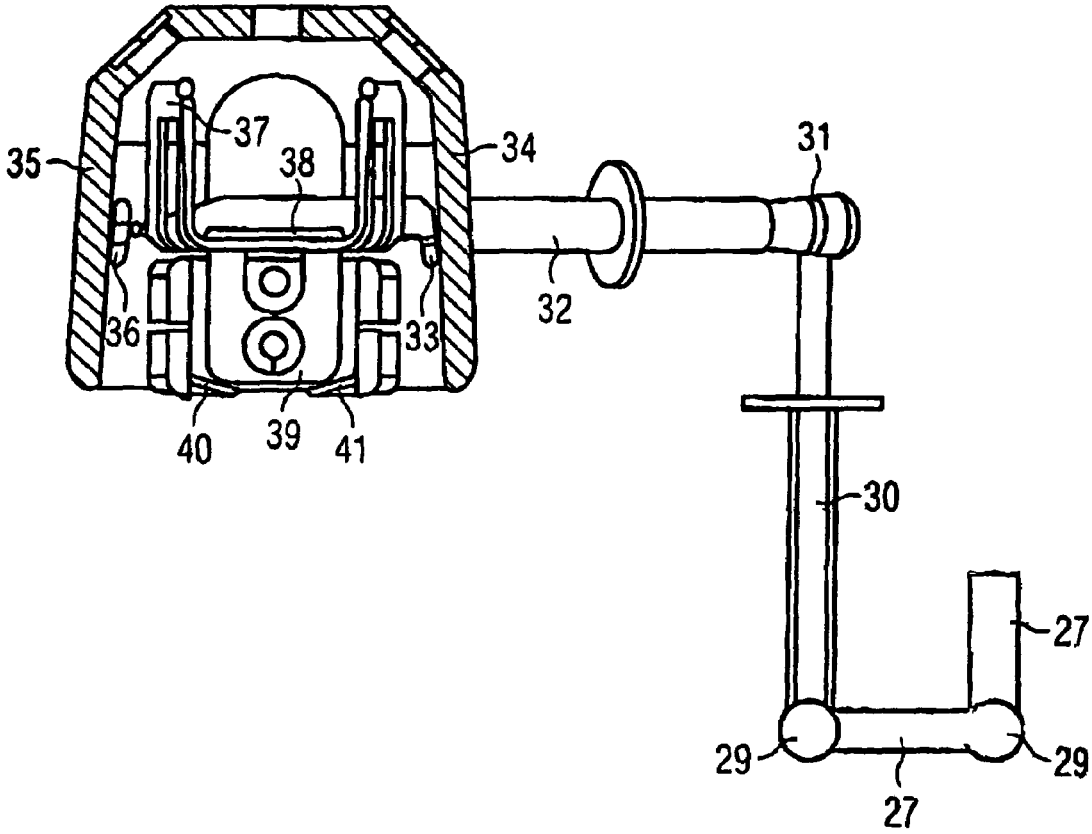
FIG. 3 is a diagrammatic, cross-sectional view of a trigger mechanism of the locking apparatus according to the invention.

FIG. 3 shows a cross-sectional view of the trigger mechanism 28. The sliding linkage 27 is coupled to the trigger mechanism 28 via joints 29 and a further sliding rod 30, in that the sliding rod 30 transmits sliding movement to a rocker lever 32 by a joint 31. The rocker lever 32 is mounted rotatably in a bearing hole 33 of a housing 34 of the trigger mechanism 28 and extends through an interior wall of the housing 34 as far as a clearance of a guide part 37 that is provided for limiting the movement of the rocker lever 32. Inside the housing 34, the rocker lever 32 extends through the guide part 37 that limits a clockwise movement of the rocker lever 32. Below the rocker lever 32 which is in a horizontal position is disposed a folding plate 38 which is connected to a clip mechanism 39 and tension springs 40, 41. The position of the trigger mechanism 28 of FIG. 3 is a position, with a backup 42 engaged and functioning.

The trigger mechanism 28 disposed underneath the locking mechanism 7 is held in the position of FIG. 3 via the dead weight of the sliding linkage 27 or by a non-illustrated spring mechanism as long as the backup 42 is engaged and functioning, that is to say, in particular, with a trigger pin not projecting.

Figure 4:
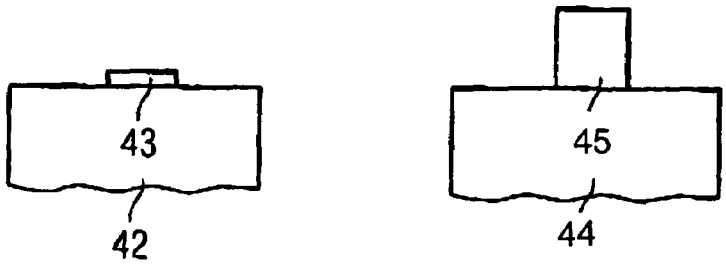
FIG. 4 is a diagrammatic illustration of a functioning backup and a defective backup.

FIG. 4 shows diagrammatically a functioning backup 42, with a trigger pin 43 not projecting, and a defective backup 44, with a trigger pin 45 projecting.

The trigger mechanism 28 and the functioning of the locking apparatus are described in more detail below with reference to FIGS. 5, 6 and 7.

Figure 5:
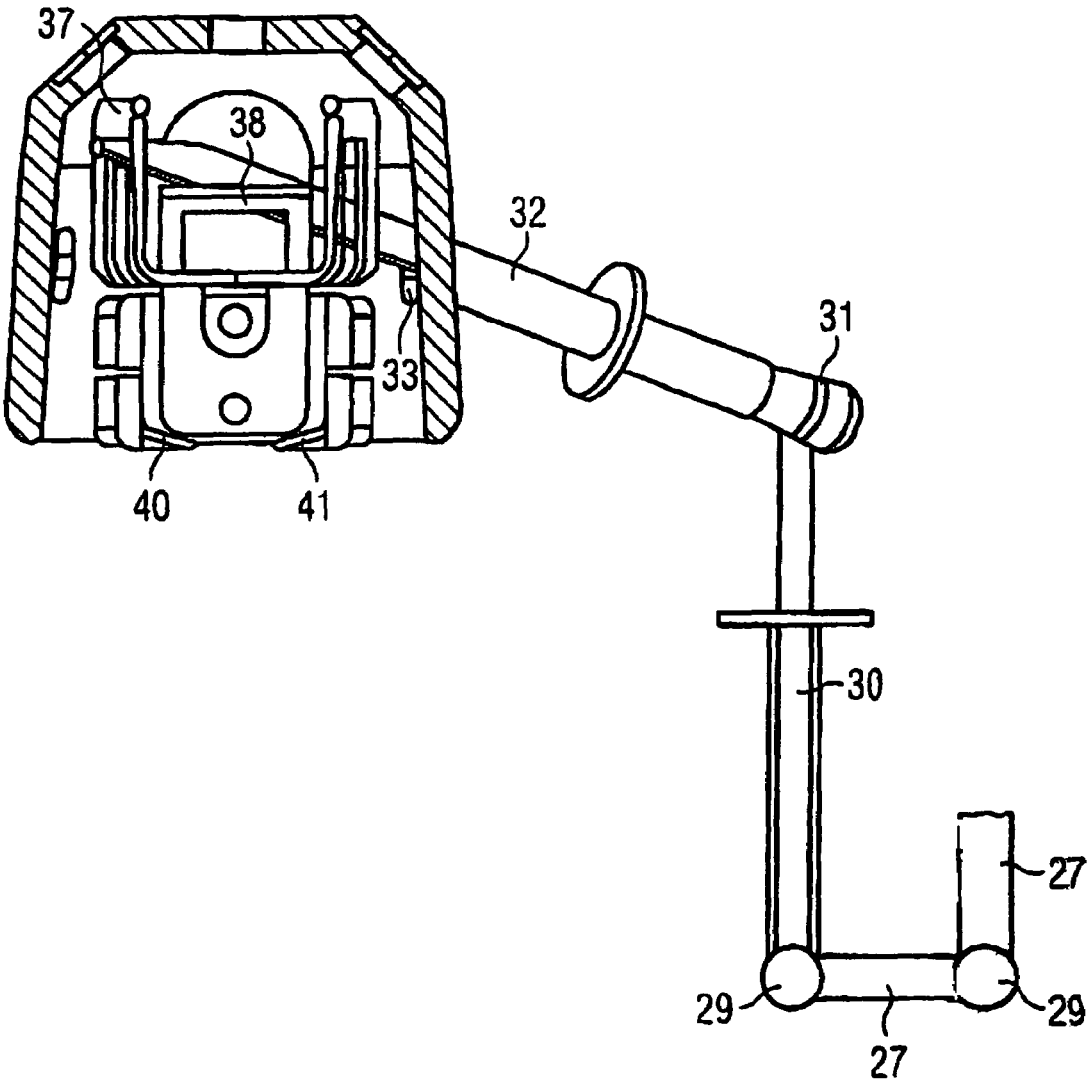
FIG. 5 is a diagrammatic, cross-sectional view of the trigger mechanism of the locking apparatus according to the invention in a triggered position.

FIG. 5 shows the trigger mechanism 28 of FIG. 3 in a position in which the backup 42 is absent. The folding plate 38 acts as a blocking element on the rocker lever 32 counter to the force acting in the opposite direction on the rocker lever 32 owing to the dead weight of the sliding linkage 27 or to the spring mechanism. Due to the force exerted directly on the rocker lever 32 by the trigger pin 45 and the defective backup 44, the rocker lever 32 is rotated clockwise about its bearing in the bearing hole 33 and is located in the position of FIG. 5, the rotation of the rocker lever 32 being limited by the guide part 37. As a result of the clockwise movement of the rocker lever 32 about the bearing hole 33, the sliding rod 30 is induced via the joint 31 to a downward movement and the sliding linkage 27 is induced via the joints 29 to a sliding movement that acts on the end 26 of the cover plate 16. When the defective backup is removed, the folding plate 38 is folded into the position illustrated in FIG. 5 by the tensile force of the springs 40, 41. The folding plate 38 remains in this position until a new backup is engaged, the folding plate 38 being folded back into the position illustrated in FIG. 3 by the clip mechanism 39.

Figure 6:
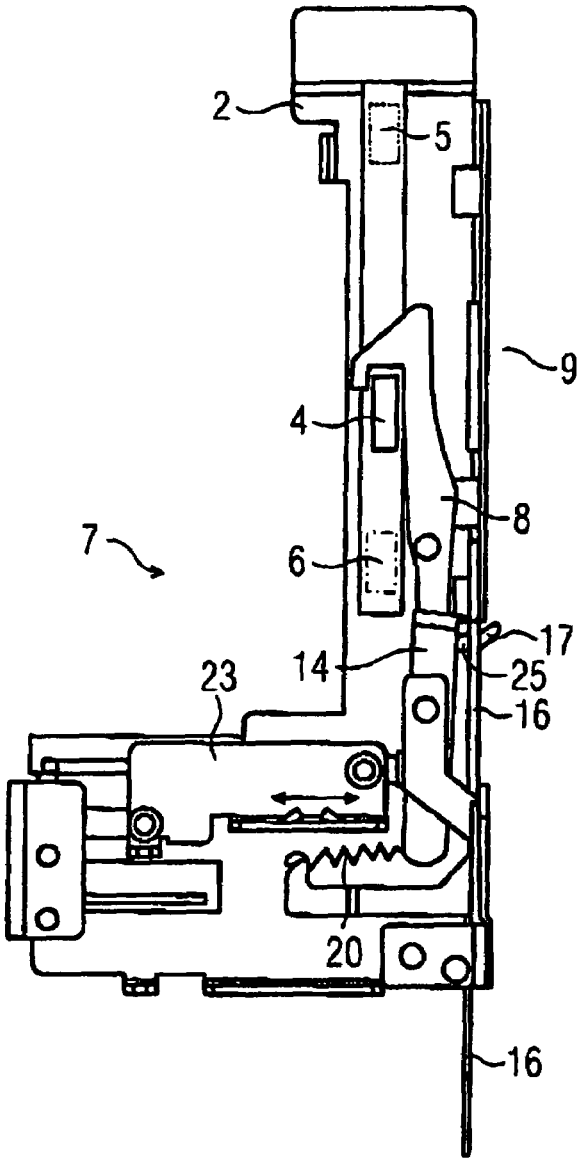
FIG. 6 is a diagrammatic, rear view of a locking mechanism of the locking apparatus according to the invention in a locking position.
Figure 7:
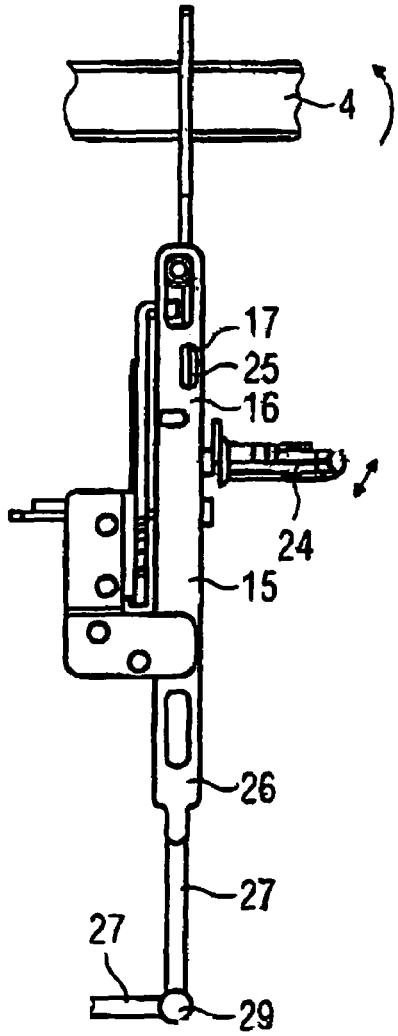
FIG. 7 is diagrammatic, side view of the locking mechanism shown in FIG. 6.

FIGS. 6 and 7 show the locking apparatus in a locked state that is reached by a triggered backup. As described with reference to FIG. 5, a triggered backup causes a movement of the sliding linkage 27, with the result that the cover plate 16 is displaced in such a way that the clearance 25 of the cover plate 16 releases the stop element 17 of the locking lever 8. In the position of FIG. 6, the stop element 17 passes through the clearance 25 of the cover plate 16. When the stop element 17 comes into the region of the clearance 25 during the movement of the cover plate 16, a force acting on the trigger lever 14 via the tension spring 20 brings about a clockwise rotation of the trigger lever 14 about the second bearing 18, with the result that the locking lever 8 is induced to a counterclockwise rotation about the first bearing 12. The locking lever 8 assumes a position in which the opening slot 3 of the housing part 2 is blocked for movement of the switch lever 4 in the direction of the current-carrying position 5 by the extension 11 of the locking lever 8. When the switch lever 4 is in the current-carrying position 5, a switch-off operation can be carried out via the sliding face 10 of the locking lever 8, since, in the event of a movement of the switch lever 4 out of the current-carrying position 5 into the switched-off position 6, the switch lever 4 slides along the sliding face 10 and at the same time induces the rotatably mounted locking lever 8 to a clockwise movement, with the result that the locking lever 8 releases the opening slot 3 until the switch lever has moved under the free end 9 of the locking lever 8. In this position, via the force acting on the locking lever 8 by the tension spring 20 and the trigger lever 14, the locking lever 8 is again induced to a counterclockwise movement, so that it subsequently blocks the opening slot 3 again. A movement out of the lower switched-off position 6 into the current-carrying position 5 is prevented by the extension 11 of the locking lever 8.

A release of the lock by the locking lever 8 for the switch lever 4 is possible by the hand-operated actuating mechanism 24 and the return mechanism 23, in that, via the hand-operated actuating mechanism 24, the return mechanism 23 acts, during movement in the direction of the trigger lever 14, against the end 19 of the trigger lever 14 and induces the latter to a counterclockwise rotation, with the result that the locking lever 8 moves clockwise and releases the opening slot 3 again for a movement of the shift lever 4. In this case, the engagement of the stop element 17 into the clearance 25 and the cover plate 16 is cancelled. If, furthermore, a new backup, with the trigger pin not projecting, is engaged into the housing 34 of the trigger mechanism 28, then the clip mechanism 39 causes the folding plate 38 to be folded back into a horizontal position, so that, via the dead weight of the sliding linkage 27, the cover plate 16 is moved downward and, via the sliding linkage 27, the joints 29 and the sliding rod 30, the rocker lever 32 is rotated back into its horizontal position.

If, however, no new backup has been engaged into the housing 34 of the trigger mechanism 28, then the folding plate 38 remains in its folded-out position and prevents the rocker lever 32 from being rotated back into the horizontal position, even in the event of a manual actuation of the hand-operated actuating mechanism 24, since the movement of the cover plate 16 via the sliding linkage 27 and the sliding rod 30 is prevented and blocked due to the blocking of the rocker lever 32 by the folding plate 38.

Thus, by the locking apparatus, on the one hand, in the event of defective backup, with a trigger pin projecting, a switching operation of the electrical switching equipment by the shift lever 4 from the switched-off position 6 to the current-carrying position 5 is prevented, as described with reference to FIG. 6, and, on the other hand, a release of the locking apparatus of the opening slot 3 for a movement of the switch lever 4 out of the switched-off position 6 into the current-carrying position 5 is prevented even when no new functioning backup has been engaged into the housing 34.

We claim:

1. A locking apparatus for a manual actuation device for electrical switching equipment, the locking apparatus comprising:

a trigger mechanism activated by an absence of a backup or a defective backup; and a locking mechanism for the manual actuation device and having a lever configuration, said locking mechanism coupled to said trigger mechanism and being transferable by said trigger mechanism from a first position releasing the manual actuation device into a second position locking the manual actuation device, said locking mechanism having a cover plate being displaceable between the first and second positions by said trigger mechanism and, in the first position, said cover plate blocking said lever configuration, under tensile force, of said locking mechanism and, in the second position, said locking mechanism releases said lever configuration to lock the manual actuation device.

2. The locking apparatus according to claim 1, wherein:

the electrical switching equipment has a housing with a bearing arm; and said lever configuration has a tension spring, a rotatably mounted locking lever and a trigger lever mounted rotatably on the bearing arm, said trigger lever has a first end coupled to the housing of the electrical switching equipment via said tension spring and a second end connected in an articulated manner to said locking lever.

3. The locking apparatus according to claim 2, wherein:

said cover plate has a clearance formed therein; and said trigger lever has a stop element for engagement into said clearance of said cover plate in the second position.

4. The locking apparatus according to claim 2, wherein said locking lever has a free end with a sliding face pointing in a direction of a switched-on position of the manual actuation device and an extension pointing in a direction of a switched-off position of the manual actuation device.

5. The locking apparatus according to claim 2, wherein said locking mechanism has a manual return mechanism coupled to said trigger lever and a hand-operated actuating lever.

6. The locking apparatus according to claim 1, further comprising a sliding linkage and joints coupling said cover plate to said trigger mechanism.

7. The locking apparatus according to claim 6, wherein said trigger mechanism includes:

a backup housing end part; and a rocker lever connected in an articulated manner to said sliding linkage and disposed rotatably in said backup housing end part and extends into said backup housing end part and beyond the backup.

8. The locking apparatus according to claim 1, wherein said trigger mechanism includes:

tension spring elements; and a folding plate which can be moved between a folded-in position and a folded-out position by a clip mechanism of the backup and said tension spring elements of said trigger mechanism.

* * * * *